US010597961B2

(12) United States Patent
Wubben et al.

(10) Patent No.: US 10,597,961 B2
(45) Date of Patent: Mar. 24, 2020

(54) METHOD AND SYSTEM FOR LOCKING AN UPPER END OF AN EXPANDED TUBULAR WITHIN A HOST CASING

(71) Applicant: SHELL OIL COMPANY, Houston, TX (US)

(72) Inventors: Antonius Leonardus Maria Wubben, Rijwsijk (NL); Tino Walter Van Der Zee, Joure (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 156 days.

(21) Appl. No.: 15/855,153

(22) Filed: Dec. 27, 2017

(65) Prior Publication Data

US 2018/0119504 A1 May 3, 2018

Related U.S. Application Data

(63) Continuation of application No. PCT/EP2016/065113, filed on Jun. 28, 2016.

(30) Foreign Application Priority Data

Jul. 1, 2015 (EP) ..... 15174881

(51) Int. Cl.
*E21B 23/01* (2006.01)
*E21B 43/10* (2006.01)

(52) U.S. Cl.
CPC ..... *E21B 23/01* (2013.01); *E21B 43/103* (2013.01); *E21B 43/105* (2013.01)

(58) Field of Classification Search
CPC ..... E21B 23/01; E21B 43/105
See application file for complete search history.

(56) References Cited

U.S. PATENT DOCUMENTS

| | | | | |
|---|---|---|---|---|
| 3,045,757 | A | 7/1962 | Conrad | |
| 6,062,309 | A | 5/2000 | Gosse | |
| 2004/0216891 | A1 | 11/2004 | Maguire | |
| 2012/0037381 | A1 | 2/2012 | Giroux et al. | |
| 2013/0312954 | A1* | 11/2013 | Di Crescenzo | E21B 33/1292 166/207 |

FOREIGN PATENT DOCUMENTS

| | | | |
|---|---|---|---|
| EP | 2415963 | A2 | 2/2012 |
| GB | 2361727 | A | 10/2001 |
| GB | 2401127 | A | 11/2004 |
| WO | 2012104257 | A1 | 8/2012 |

OTHER PUBLICATIONS

International Search Report and Written Opinion received for PCT Patent Application No. PCT/EP2016/065113, dated Sep. 14, 2016, 9 pages.

* cited by examiner

*Primary Examiner* — D. Andrews

(57) ABSTRACT

A to be expanded tubular (4) can be locked to a previously installed host casing (2) using a self energizing top anchor (SETA) tool. This SETA tool has an anchoring section with a set of anchoring slips (1), and a centralizer which is connected to the body of the anchoring section. The anchoring slips (1) engage the host casing (2) once an expansion cone (3) presses the tubular against the shoulder of the centralizer. The SETA tool is further provided with a guide nose (7) to which a force transmission sub (8) is connected.

14 Claims, 4 Drawing Sheets

METHOD AND SYSTEM FOR LOCKING AN UPPER END OF AN EXPANDED TUBULAR WITHIN A HOST CASING

CROSS REFERENCE TO RELATED APPLICATIONS

This is a Continuation application of International Application PCT/EP2016/065113, filed 29 Jun. 2016, which claims priority of European application 15174881.1, filed 1 Jul. 2015.

FIELD OF THE INVENTION

The present invention relates to a self-energizing top anchor tool for releasably locking a tubular to a previously installed host casing, and a method for releasably locking a tubular to a previously installed host casing with such a tool.

BACKGROUND OF THE INVENTION

US 2012/037381 A, US 2004/0216891 A, and US 2013/312954 A each disclose a method and system wherein locking an upper end of an expanded tubular within a previously installed host casing. In the system of US 2013/312954 A the upper end of a to be expanded tubular is locked within a previously installed host casing using a top anchor, also known as the SETA tool.

The known SETA tool may be used as a top a in a Top Anchor and Pull (TAaP) system to enable the initial expansion of a liner by anchoring the top of the liner to the host casing. When the expansion cone has entered the overlap section the anchor is released by an interceptor sub contained in the expansion tool string.

The following problems may be experienced with the known SETA tool:

Handling of the SETA tool with centralizer sub and spacing out of the SETA tool in the expansion tool string with respect to the top of the liner is a cumbersome job on the rig.

The SETA tool may not release when an anchoring force is still present

When the liner shortens from the top during expansion and at a later stage re-engages the SETA tool again (e.g. because Open hole Anchors start slipping) then the liner is not properly centralized anymore against the SETA tool with the risk of malfunctioning.

Tool joints of the expansion tool string may prematurely release the SETA tool after the Open hole Anchors have been set.

There is a need for an improved SETA tool and expansion method in which these problems are inhibited.

SUMMARY OF THE INVENTION

In accordance with the invention there is provided a method for locking a to be expanded tubular to a previously installed host casing with a SETA locking tool comprising:

an anchoring section with a set of anchoring slips which engage the host casing;

a guide nose; and a force transmission sub connected to the guide nose which sub comprises:

an outer sleeve that is locked to the sub by a collet; and an inner sleeve which is located inside the sub is locked in place by a set of shear pins and which also locks the collet in place, optionally via a set of rollers.

In accordance with the invention there is furthermore provided a SETA locking tool for locking an expanded tubular to a previously installed host casing comprising:

an anchoring section with a set of anchoring slips which engage the host casing once an expansion cone presses the tubular against the shoulder of a centralizer which is connected to the body of the anchoring section;

a guide nose; and a force transmission sub connected to the guide nose, which sub comprises:

an outer sleeve that is locked to the sub by a collet; and an inner sleeve which is located inside the sub is locked in place by a set of shear pins and which also locks the collet in place, optionally via a set of rollers.

These and other features, embodiments and advantages of the method and system according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

DETAILED DESCRIPTION OF THE DEPICTED EMBODIMENTS

Proposed herein are a method and system for locking an upper end of a to be expanded tubular within a previously installed host casing.

The improved SETA tool described in detail hereafter may solve one or more of the issues associated with the SETA tool of US 2013/312954 A.

Figure 1:
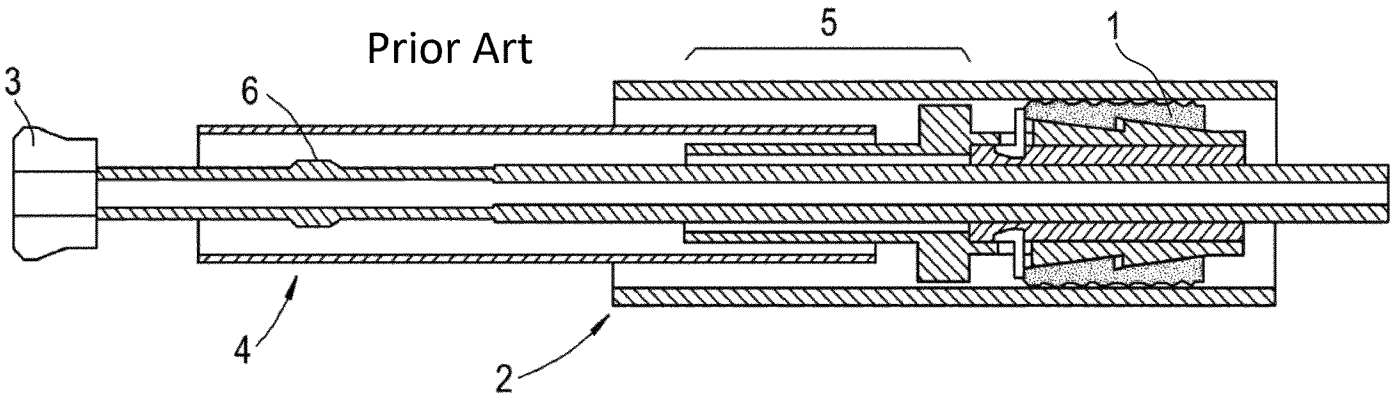
Prior Art Fig.1
FIG. 1 shows a known SETA tool from US 2013/312954 A.

A Self Energizing Top Anchor (SETA) as described in US 2013/312954 A is shown in FIG. 1.

FIG. 1 shows that the known SETA tool comprises a set of anchoring slips 1 which engage the host casing 2 once the cone 3 presses the still at least partially unexpanded tubular, also referred to as the liner 4, against the shoulder of the centralizer 5, which is connected to the body of the anchoring section.

When the cone is in the overlap section with the host casing an interceptor sub 6 contacts a sleeve in the SETA tool which lifts the slip segments to eliminate the anchoring function so that the tool can be carried out of the hole by the expansion tool string.

Figure 2:
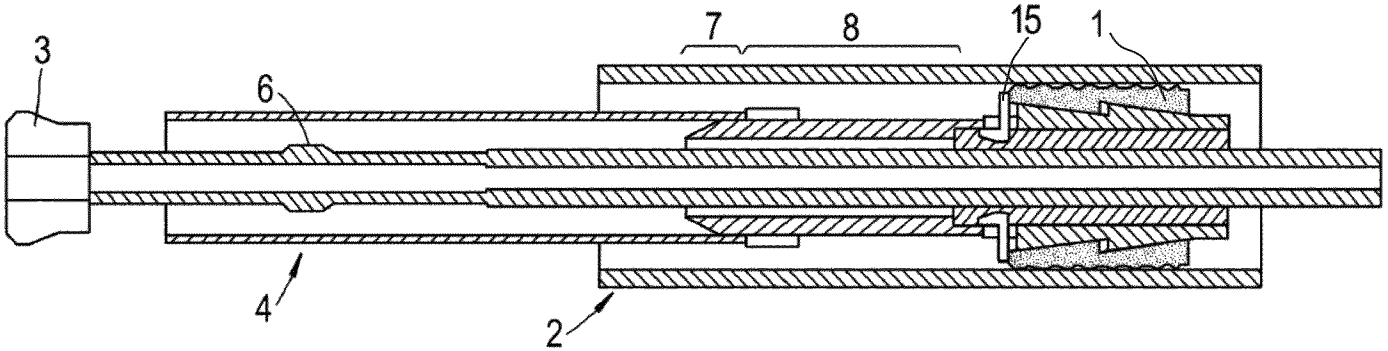
FIG. 2 shows an improved SETA tool.

FIG. 2 shows an improved SETA tool with a liner guide nose and a force release sub. The conventional centralizer sub 5 of FIG. 1 is replaced by a guide nose 7 and a force transmission sub 8. The guide nose 7 is connected to the force transmission sub 8. FIG. 2 shows a release sleeve 15 that is connected to the anchoring slips 1.

The guide nose 7 is designed such that the tip of the nose 7 will enter into the top of the liner 4 when the latter moves towards the nose even when the liner is sliding on the low side of the host casing 2. This eliminates the need for a long centralizer sticking into the top of the liner to allow for mechanical and thermal elongation and shortening of the liner during assembly and running into the hole.

In addition, this guide nose 7 will also properly centralize the top of the liner in case the Open Hole Anchor or SETA tool may start slipping during expansion of the liner.

The force transmission sub 8 is connected to the body of the anchoring section of the SETA tool.

Figure 3:
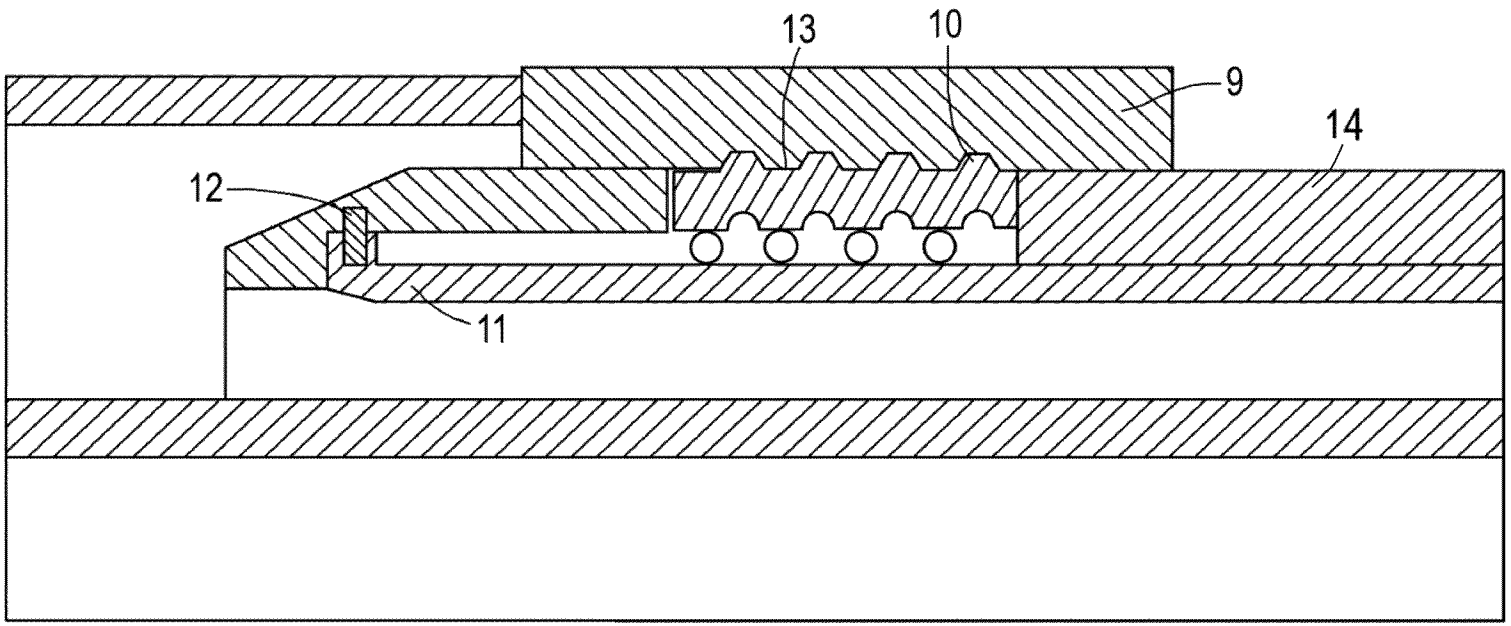
FIG. 3 shows how force is transmitted when the force transmission sub in the SETA locking tool is in a locked position.

FIG. 3 shows the force transmission sub 8 in locked position. The force transmission sub 8 contains an outer sleeve 9 which is locked to the sub by a collet 10. The force transmission sub 8 further comprises a tubular body 14.

FIG. 3 further shows that an inner sleeve 11 inside the sub is locked in place by a set of shear pins 12. The inner sleeve also locks the collet 10 in place via a set of rollers 20.

When the expansion force is applied the top of the liner contacts the outer sleeve 9. The force is then transmitted via the collet 10 to the body of the sub 8 which transmits the force via the body of the anchoring section and the slips to the host casing.

FIGS. 4A-D show how the force transmitted by the sub is released in four steps by the interceptor sub.

Figure 4A:
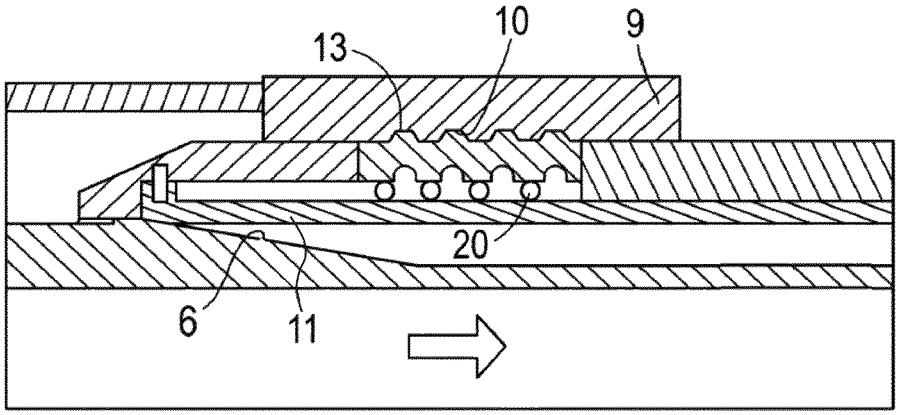
FIGS. 4A-D show how the force transmission sub is released and the improved SETA tool is released in four steps.

FIG. 4A shows step 1, wherein an inceptor shoulder touches a release sleeve. The interceptor sub contacts the inner sleeve 11 but cannot pass through it.

Figure 4B:
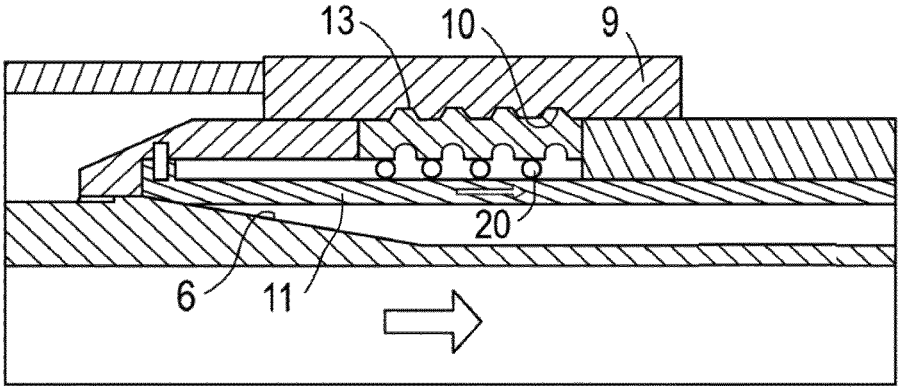

FIG. 4B shows step 2 wherein shear pins shear, and the release sleeve starts moving. The force applied by the interceptor sub fails the shear pins and the inner sleeve 11 starts moving with the interceptor sub.

Figure 4C:
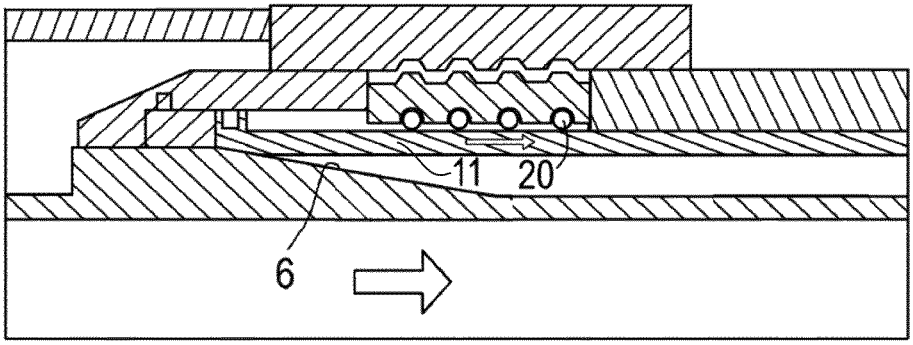

FIG. 4C shows step 3 wherein the shoulder lock releases. As a result of the movement shown in FIG. 4B, the rollers start rolling and thereby unlock the collet 10 so that the outer sleeve 9 can slide over the body of the sub 6. The stroke of the outer sleeve 9 is sufficient to allow the axial strain developed in the liner 4 to be released.

Figure 4D:
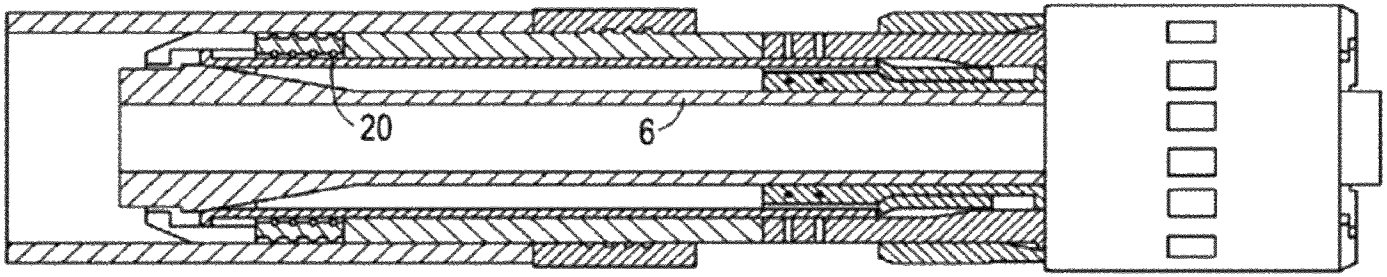

FIG. 4D shows, in step 4, unlocking of the force transmission sub and release of the SETA tool. Upon further movement of the inner sleeve 11 it contacts a release sleeve that is connected to the anchoring slips. Now the body of the anchoring section of the SETA tool no longer transmits load to the slips so that the latter can be lifted by the inner sleeve 11. Subsequently the SETA tool is carried out of the hole by the interceptor sub 6 via the inner sleeve and the slips of the anchoring section.

The shape of the entry section of the guide nose 7 and the taper at the inside of the inner sleeve 11 shown in FIGS. 3 and 4 is designed such that the tapered section at the top of a tool joint of a drill pipe will slide on the ID of the guide nose and cannot contact the inside of the inner sleeve. This way the risk of premature release of the SETA tool by drill pipe tool joint is eliminated.

Therefore, the method, system and/or any products according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist" of the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

What is claimed is:

1. A method for releasably locking a tubular to a previously installed host casing with a self-energizing top anchor (SETA) tool comprising:

an anchoring section with a body and a set of anchoring slips which can engage the host casing;

a guide nose; and a force transmission sub connected to the guide nose, which force transmission sub comprises:

a tubular body;

an outer sleeve that is locked to the tubular body of the force transmission sub by a collet; and an inner sleeve which is located inside the tubular body of the force transmission sub and locked in place by a set of shear pins and which also locks the collet in place;

the method comprising: pressing the top of the tubular in contact with the outer sleeve using an expansion cone, whereby a tip of the guide nose enters into the top of the tubular and whereby an expansion force is then transmitted via the collet to the tubular body of the force transmission sub, which transmits the force via the body of the anchoring section to the slips which then engage the host casing, whereby the outer sleeve can be unlocked by applying a force to the inner sleeve whereby the shear pins fail allowing movement of the inner sleeve within the tubular body of the force transmission sub to unlock the collet, so that the outer sleeve can slide over the tubular body of the force transmission sub.

2. The method of claim 1, wherein the stroke of the outer sleeve on the tubular body of the force transmission sub is sufficient to allow axial strain developed in the tubular to be released.

3. The method of claim 1, wherein the collet is locked in place via a set of rollers.

4. The method of claim 3, wherein the collet comprises recesses for the rollers whereby unlocking the collet comprises rolling the rollers into the recesses.

5. The method of claim 1, further comprising releasing the expansion force transmitted by the force transmission sub in four steps by an interceptor sub contained in an expansion tool string extending through the inner sleeve, wherein:

I) in a first step the interceptor sub contacts the inner sleeve but cannot pass through it;

II) in a second step the force applied by the interceptor sub fails the shear pins and the inner sleeve starts moving with the interceptor sub;

III) in a third step the rollers start rolling and thereby unlock the collet so that the outer sleeve can slide over the tubular body of the force transmission sub; and IV) in a fourth step upon further movement of the inner sleeve it contacts a release sleeve that is connected to the anchoring slips such that the body of the anchoring section of the SETA tool no longer transmits load to the slips so that the latter is lifted by the inner sleeve, whereupon the SETA tool is carried out of the hole by the interceptor sub via the inner sleeve and the slips of the anchoring section.

6. A self energizing top anchor (SETA) tool for releasably locking a to be expanded tubular to a previously installed host casing; the tool comprising:

an anchoring section with a body and a set of anchoring slips which can engage the host casing;

a guide nose comprising a tip that in operation can enter into the top of the tubular; and a force transmission sub connected to the guide nose, which force transmission sub comprises:

a tubular body;

an outer sleeve that is locked to the tubular body of the force transmission sub by a collet whereby an expansion force caused by pressing the top of the tubular in contact with the outer sleeve is transmittable via the collet to the tubular body of the force transmission sub, which transmits the force via the body of the anchoring section to the slips which then engage the host casing; and an inner sleeve which is located inside the tubular body of the force transmission sub and locked in place by a set of shear pins and which also locks the collet in place;

whereby the outer sleeve can be unlocked by applying a force to the inner sleeve whereby the shear pins fail, allowing movement of the inner sleeve within the tubular body of the force transmission sub to unlock the collet, so that the outer sleeve can slide over the tubular body of the force transmission sub.

7. The SETA tool of claim 6, wherein the stroke of the outer sleeve on the tubular body of the force transmission sub is sufficient to allow axial strain developed in the tubular pressed in contact with the outer sleeve to be released.

8. The SETA tool of claim 6, wherein the collet is locked in place via a set of rollers.

9. The SETA tool of claim 8, wherein the collet comprises recesses for the rollers whereby the collet is unlocked when the rollers are in the recesses.

10. The SETA tool of claim 6, further comprising a release sleeve that is connected to the anchoring slips such that the body of the anchoring section of the SETA tool no longer transmits load to the slips, which release sleeve is contacted by the inner sleeve when the collet is unlocked, so that the release sleeve is lifted by the inner sleeve where after the anchoring section no longer transmits load to the slips.

11. The SETA tool of claim 6, wherein the inner sleeve has a tapered inside wall at a lower end to facilitate contact with an interceptor sub.

12. A method for locking a to be expanded tubular to a previously installed host casing with a self energizing top anchor (SETA) locking tool comprising:

an anchoring section comprising a body and with a set of anchoring slips which engage the host casing;

a guide nose; and a force transmission sub connected to the guide nose, which force transmission sub comprises:

a tubular body;

an outer sleeve that is locked to the tubular body of the force transmission sub by a collet; and an inner sleeve which is located inside the tubular body of the force transmission sub is locked in place by a set of shear pins and wherein the inner sleeve also locks the collet in place via a set of rollers;

said method comprising applying an expansion force to the to be expanded tubular, whereby contacting the outer sleeve with a top of the to be expanded tubular, and transmitting said expansion force via the collet to the tubular body of the force transmission sub, which transmits the said force via the body of the anchoring section and the slips to the host casing.

13. The method of claim 12, wherein the force transmission sub is furthermore configured such that the expansion force transmitted by the force transmission sub is released in four steps by an interceptor sub, wherein:

I) in a first step the interceptor sub contacts the inner sleeve but cannot pass through it;

II) in a second step the force applied by the interceptor sub fails the shear pins and the inner sleeve starts moving with the interceptor sub;

III) in a third step the rollers start rolling and thereby unlock the collet so that the outer sleeve can slide over the tubular body of the force transmission sub whilst a stroke of the outer sleeve is sufficient to allow the axial strain developed in the tubular to be released; and IV) in a fourth step upon further movement of the inner sleeve it contacts a sleeve that is connected to the anchoring slips such that the body of the anchoring section of the SETA tool no longer transmits load to the slips so that the latter can be lifted by the inner sleeve, whereupon the SETA tool is carried out of the hole by the interceptor sub via the inner sleeve and the slips of the anchoring section.

14. A self energizing top anchor (SETA) locking tool for locking a to be expanded tubular to a previously installed host casing; the tool comprising:

an anchoring section comprising a body and a set of anchoring slips which engage the host casing;

a guide nose; and a force transmission sub connected to the guide nose, which the force transmission sub comprises an outer sleeve that is locked to the force transmission sub by a collet, and an inner sleeve which is located inside the force transmission sub is locked in place by a set of shear pins and wherein the inner sleeve also locks the collet in place via a set of rollers.

* * * * *